US006740629B2

(12) United States Patent
Ando et al.

(10) Patent No.: US 6,740,629 B2
(45) Date of Patent: May 25, 2004

(54) COMPOSITION FOR WASHING A POLISHING PAD AND METHOD FOR WASHING A POLISHING PAD

(75) Inventors: Michiaki Ando, Tokyo (JP); Nobuo Kawahashi, Tokyo (JP); Masayuki Hattori, Tokyo (JP)

(73) Assignee: JSR Corporation, Tokyo (JP)

( * ) Notice: Subject to any disclaimer, the term of this patent is extended or adjusted under 35 U.S.C. 154(b) by 85 days.

(21) Appl. No.: 10/166,111

(22) Filed: Jun. 11, 2002

(65) Prior Publication Data

US 2003/0004085 A1 Jan. 2, 2003

(30) Foreign Application Priority Data

Jun. 13, 2001 (JP) ..... 2001-179292

(51) Int. Cl.[7] ..... C11D 3/22; C11D 14/02; C23G 3/22; C23G 14/02

(52) U.S. Cl. ..... 510/245; 510/254

(58) Field of Search ..... 510/245, 254, 510/255, 276

(56) References Cited

U.S. PATENT DOCUMENTS

| | | | |
|---|---|---|---|
| 5,876,508 | A | 3/1999 | Wu et al. |
| 6,194,366 | B1 | 2/2001 | Naghshinch et al. |
| 2001/0001785 | A1 | 5/2001 | Honda et al. |

FOREIGN PATENT DOCUMENTS

| | | |
|---|---|---|
| JP | 8-83780 | 3/1996 |
| JP | 10-116804 | 5/1998 |
| JP | 11-116948 | 4/1999 |
| JP | 2000-309796 | 11/2000 |
| JP | 2001-110759 | 4/2001 |
| WO | WO 00/37217 | 6/2000 |
| WO | WO 00/51783 | 9/2000 |
| WO | WO 00/73021 | 12/2000 |

*Primary Examiner*—Yogendra N. Gupta
(74) *Attorney, Agent, or Firm*—Oblon, Spivak, McClelland, Maier & Neustadt, P.C.

(57) ABSTRACT

An object of the present invention is to provide a composition for washing a polishing pad which removes a water-insoluble compound which was separated from a surface to be polished during polishing, formed at least on the surface of a polishing pad, and comprised a metal ion ionized, and a method for washing a polishing pad using the same. The composition for washing a polishing pad of the present invention is obtained by, in the case a water-insoluble compound is a copper quinaldinic acid complex, blending ammonia as a component for rendering the water-insoluble compound water-soluble and glycine as a water-soluble complex forming component for forming a water-soluble complex with a copper ion, and stirring them. In addition, in a method for washing a polishing pad using the composition for washing a polishing pad, a polishing pad can be washed effectively, the productivity can be improved and, further, consumption of a polishing pad can be inhibited.

18 Claims, 1 Drawing Sheet

COMPOSITION FOR WASHING A POLISHING PAD AND METHOD FOR WASHING A POLISHING PAD

BACKGROUND OF THE INVENTION

1. The Field of the Invention

The present invention relates to a composition for washing a polishing pad and a method for washing a polishing pad. More particularly, the present invention relates to a composition for washing a polishing pad which can effectively recover by inhibiting clogging generated in a polishing pad used for polishing wherein a water-insoluble compound are formed during polishing, and consumption of the polishing pad, and a method for washing a polishing pad using the composition for washing a polishing pad.

2. Description of the Prior Art

In chemical mechanical polishing (hereinafter, simply referred to as "CMP") used for polishing a semiconductor wafer and the like, polishing is performed by supplying a slurry (aqueous dispersion) containing abrasive or the like to an interface between a polishing pad and a surface to be polished. In the case of using a porous material such as expanded polyurethane or the like as a polishing pad, clogging due to a wastage is gradually proceeding, and a removal rate is reduced. For this reason, in order to recover the surface of the polishing pad to the state suitable for CMP, a step for renewing a polishing surface called as dressing is performed. This dressing is performed by sliding a polishing body (dresser) with diamond powder or the like attached thereto on the surface of the polishing pad. As this dressing, a method designated "in situ dressing", and a method designated "interval dressing" are known. The former is a method for dressing a region of a polishing pad which has not been polished during polishing, and the latter indicates a method for performing only dressing while polishing is stopped.

In today's CMP, in situ dressing is performed if necessary and, however, interval dressing is usually essential. The interval dressing is performed for around 5 to 30 seconds every polishing of one material to be polished. For this reason, there is a certain limit to improvement in a product yield. Further, in the interval dressing, only physical dressing is performed or dressing is performed while cooling water is supplied. However, there is scarcely an attempt to also use the chemical effects.

Recently, there has been disclosed an interval dressing using a cleaning agent composition containing an anionic surfactant in JP-A 2000-309796. However, such the cleaning agent composition can be used widely irrespective of a kind of a surface to be polished and a slurry used for polishing, whereas it is not necessarily a most suitable cleaning agent composition depending upon components constituting a semiconductor wafer and components contained in the slurry.

In addition, in JP-A 8-83780, JP-A 10-116804, JP-A 11-116948 and JP-A 2001-110759, as a slurry used in CMP, there has been disclosed methods using a slurry containing a component forming a compound which is insoluble in water containing a metal atom or its ion separated from a surface to be polished, for the purpose of preventing a metal constituting a surface to be polished from being excessively polished by a slurry, for the purpose of preventing an once polished metal from reattaching to the surface to be polished and the like.

To solve clogging to a polishing pad which was used in CMP using such the slurry is difficult by using only a mechanical treatment such as the conventional interval dressing and in situ dressing. And the interval dressing needs a longer time than the conventional one. For this reason, not only improvement in a product yield becomes further worse, but also dressing is performed for a longer period of time, a polishing pad, therefore, is consumed more, being not preferable.

SUMMARY OF THE INVENTION

The present invention is to solve the above-mentioned problems, and an object of the present invention is to provide a composition for washing a polishing pad with which a water-insoluble compound was formed on at least a part of its surface during polishing, which can recover a removal rate, and which can further inhibit consumption of a polishing pad. In addition, an object of the present invention is to provide a method for washing a polishing pad using the composition for washing polishing pad, which can improve the productivity, and which can further inhibit consumption of a polishing pad.

The present invention is described as follows.

1. A composition for washing a polishing pad, which comprises a component for rendering a water-insoluble compound containing a metal atom or its ion separated from a surface to be polished water-soluble.
2. The composition for washing a polishing pad according to 1 above, wherein the above-mentioned component for rendering water-soluble is at least one selected from the group consisting of ammonia, potassium hydroxide, tetramethylammonium hydroxide, trimethyl-2-hydroxyethylammonium hydroxide, methyltrihydroxyethylammonium hydroxide, dimethyldihydroxyethylammonium hydroxide, tetraethylammonium hydroxide and trimethylethylammonium hydroxide.
3. The composition for washing a polishing pad according to 2 above, wherein the above-mentioned metal is at least one selected from the group consisting of copper, aluminum, tungsten and tantalum.
4. The composition for washing a polishing pad according to 1 above, further comprising a component forming a water-soluble complex for forming a water-soluble complex with the above-mentioned metal atom or its ion.
5. The composition for washing a polishing pad according to 4 above, wherein the above-mentioned component for rendering water-soluble is at least one selected from the group consisting of ammonia, potassium hydroxide, tetramethylammonium hydroxide, trimethyl-2-hydroxyethylammonium hydroxide, methyltrihydroxyethylammonium hydroxide, dimethyldihydroxyethylammonium hydroxide, tetraethylammonium hydroxide and trimethylethylammonium hydroxide.
6. The composition for washing a polishing pad according to 5 above, wherein the above-mentioned component forming a water-soluble complex has two or more functional groups which can coordinate on the above-mentioned metal atom or its ion.
7. The composition for washing a polishing pad according to 6 above, wherein the above-mentioned component forming a water-soluble complex is at least one selected from the group consisting of glycine, alanine, cysteine, amidosulfuric acid, lactic acid, citric acid, tartaric acid, malic acid, malonic acid, oxalic acid, succinic acid, fumaric acid and maleic acid.
8. The composition for washing a polishing pad according to 7 above, wherein the above-mentioned metal is at least one selected from the group consisting of copper, aluminum, tungsten and tantalum.

9. A method for washing a polishing pad to which a water-insoluble compound containing a metal atom or its ion separated from a surface to be polished is attached, and is characterized in that a polishing pad is to be contacted with a composition for washing a polishing pad which contains a component for rendering a water-insoluble compound containing a metal atom or its ion separated from a surface to be polished water-soluble.

10. The method for washing a polishing pad according to 9 above, wherein the above-mentioned component for rendering water-soluble is at least one selected from the group consisting of ammonia, potassium hydroxide, tetramethylammonium hydroxide, trimethyl-2-hydroxyethylammonium hydroxide, methyltrihydroxyethylammonium hydroxide, dimethyldihydroxyethylammonium hydroxide, tetraethylammonium hydroxide and trimethylethylammonium hydroxide.

11. The method for washing a polishing pad according to 10 above, wherein the above-mentioned metal is at least one selected from the group consisting of copper, aluminum, tungsten and tantalum.

12. The method for washing a polishing pad according to 9 above, further comprising a component forming a water-soluble complex for forming a water-soluble complex with the above-mentioned metal atom or its ion in the above-mentioned composition for washing a polishing pad.

13. The method for washing a polishing pad according to 12 above, wherein the above-mentioned component for rendering water-soluble is at least one selected from the group consisting of ammonia, potassium hydroxide, tetramethylammonium hydroxide, trimethyl-2-hydroxyethylammonium hydroxide, methyltrihydroxyethylammonium hydroxide, dimethyldihydroxyethylammonium hydroxide, tetraethylammonium hydroxide and trimethylethylammonium hydroxide.

14. The method for washing a polishing pad according to 13 above, wherein the above-mentioned component forming a water-soluble complex has two or more functional groups which can coordinate on the above-mentioned metal atom or its ion.

15. The method for washing a polishing pad according to 14 above, wherein the above-mentioned component forming a water-soluble complex is at least one selected from the group consisting of glycine, alanine, cysteine, amidosulfuric acid, lactic acid, citric acid, tartaric acid, malic acid, malonic acid, oxalic acid, succinic acid, fumaric acid and maleic acid.

16. The method for washing a polishing pad according to 15 above, wherein the above-mentioned metal is at least one selected from the group consisting of copper, aluminum, tungsten and tantalum.

According to the composition for washing a polishing pad and a method for washing a polishing pad of the present invention: clogging to a polishing pad used for polishing in which a water-insoluble compound comprising a metal ion separated from a surface to be polished and ionized is formed, can be solved, thus a removal rate can be recovered, and consumption of the polishing pad can be inhibited and, further, the productivity can be improved.

DETAILED DESCRIPTION OF THE INVENTION

A composition for washing a polishing pad of the present invention is characterized in that it contains a component for rendering a water-insoluble compound containing a metal atom or its ion separated from a surface to be polished water-soluble.

The above-mentioned "metal" is not particularly limited, and includes copper, aluminum, tungsten, molybdenum, tantalum, titanium, indium, tin and the like. These metals may be alone or in combination of two or more. A valent number in ions is not particularly limited. The use of the composition for washing a polishing pad of the present invention is particularly effective in the case of at least one of copper, aluminum, tungsten and tantalum among above metals.

In addition, a material constituting the above-mentioned "surface to be polished" from which a metal atom or its ion is separated includes a simple substance of a metal, an alloy (copper-silicon alloy and copper-aluminum alloy) and the like. A process of separation from the surface to be polished is not particularly limited. For example, separation may be by ionization with an acid or an oxidizing agent contained in a slurry, or separation may be by polishing after binding the metal atom or its ion and a component forming a water-insoluble compound contained in a slurry and described below.

As a substrate for supporting the surface to be polished, it is not particularly limited but various substrates may be used. The substrate includes a semiconductor wafer which will be used as a semiconductor substrate, an LCD glass substrate, a TFT glass substrate and the like.

The above-mentioned "water-insoluble compound" is a compound which is not dissolved in a slurry during polishing and remains as a solid on a polishing surface of a polishing pad. And it also includes a water-not easily soluble compound which is not sufficiently dissolved in water but slightly dissolved in water. The solubility of the water-insoluble compound is not particularly limited but is usually less than 1 g based on 100 g of water under any condition of a pH between 1 and 12, and a temperature between 15 and 50° C. In particular, conditions which the solubility easily becomes less than 1 g based on 100 g of water are at a pH between 7 and 11 when the metal is copper, at a pH between 2 and 6 in aluminum, at a pH between 2 and 6 in tungsten, and a pH between 3 and 11 in tantalum. In addition, the water-insoluble compound may be alone or in combination of two or more.

The component forming a water-insoluble compound which forms a water-insoluble compound is not particularly limited but includes compounds containing a functional group having at least one selected from the group consisting of N, O and S, such as a hydroxyl group, an alkoxy group (methoxy group, ethoxy group and the like), a carboxyl group, a carbonyl group (methoxycarbonyl group, ethoxycarbonyl group and the like), an amino group (including primary amino group, secondary amino group, tertiary amino group, hydroxyamino group, sulfoamino group, nitroamino group, nitrosoamino group and the like), an imino group (including oxyimino group, hydroxyimino group, sulfoimino group, nitroimino group, nitrosoimino group and the like), a cyano group, a cyanato group, a nitrile group, a nitroso group, a nitrilo group, a sulfo group, a sulfonyl group, a sulfino group, a sulfonic acid group, a mercapto group, a carbamoyl group and the like (including ions of them in an aqueous medium). Further examples include an aromatic compound, a heterocyclic compound, and a fused heterocyclic compound (in particular, a cyclic fused compound containing a heterocyclic five-membered ring and a cyclic fused compound containing a heterocyclic six-membered ring), which contain the above-mentioned functional groups.

Examples of the component forming a water-insoluble compound include derivative of compounds such as pyrazine, pyridine, pyrrole, pyridazine, histidine, thiophene, triazole, tolyltriazole, indole, benzimidazole, benzotriazole, benzofuran, benzooxazole, benzothiophene, benzothiazole, quinoline, quinoxaline, quinazoline, benzoquinone, benzoquinoline, benzopyran, benzooxazine and melamine (in particular, derivative compounds having the above-mentioned functional groups), salicylaldoxime, cupferron, phosphonic acid and the like.

In addition, the water-insoluble compound includes not only a reaction product of the above-mentioned component forming a water-insoluble compound and copper, but also copper oxide obtained by oxidation by an oxidizing agent contained in a slurry.

The above-mentioned "component for rendering water-soluble" is a component for rendering the above-mentioned water-insoluble compound water-soluble. It is preferable that the water-insoluble compound can be sufficiently dissolved in water by adding water to the surface of a polishing pad, by soaking a polishing pad in water and the like, with the component for rendering water-soluble. The component for rendering water-soluble includes ammonia, potassium hydroxide and quaternary ammonium hydroxide such as tetramethylammonium hydroxide (TMAH), trimethyl-2-hydroxyethylammonium hydroxide, methyltrihydroxyethylammonium hydroxide, dimethyldihydroxyethylammonium hydroxide, tetraethylammonium hydroxide, trimethylethylammonium hydroxide (including ions of them in an aqueous medium) and the like. Among these, ammonia and TMAH are preferred. It is particularly preferable that ammonia is used. These components may be used alone or in combination of two or more.

In addition, the above-mentioned component for rendering water-soluble can effectively render a water-insoluble compound water-soluble when the metal is copper, aluminum, tungsten and tantalum. It is particularly preferable in the case of copper.

A content of the component for rendering water-soluble in the composition for washing a polishing pad of the present invention is not particularly limited but is preferable 0.01 to 20% by weight (more preferably 0.1 to 15% by weight, most preferably 0.5 to 10% by weight) based on 100% by weight of the whole composition for washing a polishing pad.

In addition, it is preferable that a component forming a water-soluble complex which forms a water-soluble complex with a metal atom or its ion is further contained in the composition for washing a polishing pad of the present invention.

The above-mentioned "water-soluble complex" is a complex which is easily dissolved in water and can be sufficiently dissolved in water. The solubility of the water-soluble complex is not particularly limited as long as it exceeds the solubility of a water-insoluble compound under the same measuring conditions. In addition, the water-soluble complex may be alone or two kinds or more.

The above-mentioned "component forming a water-soluble complex" is a component for forming a water-soluble complex by coordination on a metal ion. The component forming a water-soluble complex usually has a functional group which is able to coordinate on a metal ion. It is preferable that the functional group has any one among N, O, and S. Functional group includes a hydroxyl group, an alkoxy group (methoxy group, ethoxy group and the like), a carboxyl group, a carbonyl group (methoxycarbonyl group, ethoxycarbonyl group and the like), an amino group (including primary amino group, secondary amino group, tertiary amino group, hydroxyamino group, sulfoamino group, nitroamino group, nitrosoamino group and the like), an imino group (including oxyimino group, hydroxyimino group, sulfoimino group, nitroimino group, nitrosoimino group and the like), a cyano group, a cyanato group, a nitrile group, a nitroso group, a nitrilo group, a sulfo group, a sulfonyl group, a sulfino group, a sulfonic acid group, a mercapto group, a carbamoyl group and the like (including ions of them in an aqueous medium).

The component forming a water-soluble complex may have only one of the functional groups or two or more (normally 6 or less, preferably 4 or less) functional groups, which can coordinate on a metal ion. Among components forming a water-soluble complex having two or more functional groups, an organic acid is particularly preferred. The organic acid includes amino acid (aminoacetic acid such as glycine, aminopropionic acid such as alanine, aminomercaptopropionic acid such as cysteine, amidosulfuric acid and the like), lactic acid, citric acid, tartaric acid, malic acid, malonic acid, oxalic acid, succinic acid, fumaric acid, maleic acid and the like (including ions of them in an aqueous medium). These may be used alone or in combination of two or more.

In the case of containing copper as a metal constituting a surface to be polished, the component forming a water-soluble complex can form a water-soluble copper complex particularly effective. It is particularly preferable that amino acid is used. It is further preferable that glycine is used because the effect for recovering a removal rate is high.

A content of the component forming a water-soluble complex in the composition for washing a polishing pad of the present invention is preferably 0.01 to 2.5% by weight (more preferably 0.1 to 20% by weight, most preferably 0.5 to 15% by weight) based on 100% by weight of the whole composition for washing a polishing pad.

The composition for washing a polishing pad of the present invention usually contains an aqueous solvent as solvents for the above-mentioned component for rendering water-soluble and the above-mentioned component forming a water-soluble complex. The composition for washing a polishing pad of the present invention can contain an additive such as a pH adjusting agent and a surfactant if necessary. The pH adjusting agent includes an organic acid such as p-toluenesulfonic acid, dodecylbenzenesulfonic acid, isoprenesulfonic acid, gleonic acid, lactic acid, citric acid, tartaric acid, malic acid, glycol acid, malonic acid, formic acid, oxalic acid, succinic acid, fumaric acid, maleic acid, phthalic acid and benzoic acid, an inorganic acid such as nitric acid sulfuric acid and phosphoric acid, an organic base such as methyl amine, ethyl amine and ethanol amine, an inorganic base such as sodium hydroxide, potassium hydroxide and sodium carbonate, and the like. Among these, organic acid, inorganic acid and organic base are preferred. And the pH adjusting agent may be used alone or in combination of two or more. The surfactant includes a cationic surfactant such as aliphatic amine salt and aliphatic ammonium salt, and the like, an anionic surfactant such as carboxylic acid salts exemplified as aliphatic acid soap and alkylether carboxylic acid salt, sulfonic acid salts exemplified as alkylbenzenesulfonic acid salt, alkylnaphthalenesulfonic acid salt and α-olefinsulfonic acid salt, sulfate ester salts exemplified as higher alcohol sulfate ester salt and alkylethersulfate salt, phosphate ester salts such as alkylphosphate ester, and the like, a nonionic surfactant such as ether-based surfactant exemplified as polyoxyethylenealkylether, etherester-based surfactant exemplified as polyoxyethylene ether of glycerin ester, ester-based surfactant exemplified as polyethylene glycol fatty acid ester, glycerin ester and sorbitan ester, and the like. By adding an appropriate amount of the above-mentioned surfactant, there is the effect of increasing the efficiency of removing a water-insoluble compound, a wastage generated during polishing and abrasive remained in a slurry are effectively removed.

It is preferable that pH of the composition for washing a polishing pad of the present invention is higher than pH of a slurry used in a polishing process. The pH is generally more than 8, and the preferred is 9 or higher when a metal constituting a surface to be polished is aluminum or tungsten, and is 11 or higher when the metal is copper or tantalum.

According to the composition for washing a polishing pad of the present invention, even in the case of a polishing pad used for CMP in which a water-insoluble compound is formed, clogging on a polishing surface of the polishing pad can be assuredly solved and a removal rate can be recovered. In this case, dressing may be or may not be performed and, when dressing is performed, a polishing surface can be more assuredly reproduced, being preferable. And further, by using the composition for washing a polishing pad of the present invention, consumption of a polishing pad by dressing can be inhibited and, the productivity (throughput) can be improved.

A method for washing a polishing pad of the present invention is a method for washing a polishing pad to which a water-insoluble compound containing a metal atom or its ion separated from a surface to be polished is attached, and is characterized in that the above-mentioned polishing pad is to be contacted with the above-mentioned composition for washing a polishing pad.

A method for contacting the composition for washing a polishing pad with the polishing pad is not particularly limited, but any methods can be used. For example, the composition for washing a polishing pad may be added dropwise to a surface of a polishing pad, or the composition may be spray-injected thereto at a high pressure. Further, a polishing pad itself may be soaked in the composition for washing a polishing pad.

In addition, when the polishing pad and the composition for washing a polishing pad are contacted, a contact may be just performed but other physical force may be applied thereto at the same time. That is, when the composition is supplied by adding dropwise as described above, a bare wafer (wafer containing no metal part) is used instead of a semiconductor wafer and the bare wafer can be slid to the polishing pad. Alternatively, a dresser may be used at the same time as conventional one. Further, the surface of a polishing pad may be cleaned with a brush or the like. In addition, when contact is performed by soaking, a high pressure stream is generated and can be applied to the surface of a polishing pad, or an ultrasound may be loaded thereto.

By using the washing method of the present invention, supplying the composition for washing a polishing pad of the present invention at a rate of 100 to 1,000 cc/min. and, further, performing interval dressing at the same time at a load of 30 to 200N to be applied to a dresser, a time from stoppage of polishing to completion of washing of a polishing pad can be 10 seconds to 5 minutes. In addition, according to the washing method of the present invention, consumption of a polishing pad can be considerably inhibited, and the number of materials to be polished which can be polished in a predetermined time can be increased, that is, the productivity can be improved. When the polishing ability of a polishing pad clogged with a water-insoluble compound, which should be a subject in the present invention, is recovered by using only interval dressing that is the conventional mechanical polishing, 10 minutes or more is usually taken. Therefore, not only there is a problem on the production efficiency, but also lifetime of a pad is adversely affected, being not practical.

According to the method for contacting the composition for washing a polishing pad, a recovery of a surface of the polishing pad can be preferably 88% or more, more preferably 90% or more.

DESCRIPTION OF THE PREFERRED EMBODIMENTS

Figure 1:
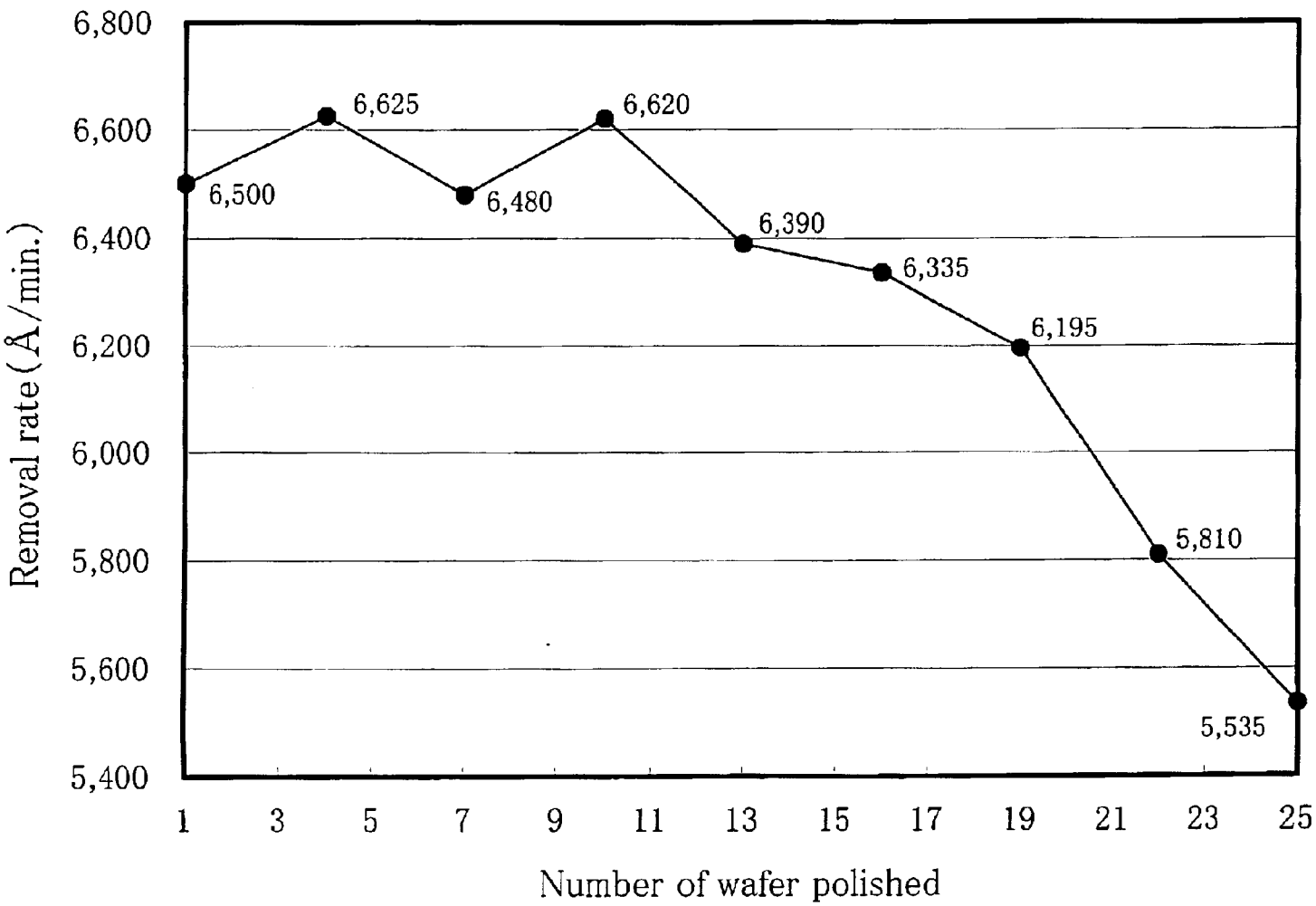
FIG. 1 is a graph showing the correlation between the number of wafers to be polished obtained in Examples and a removal rate.

The present invention will be explained in more detail by way of Examples.

[1] Preparation of Slurry (1) Slurry $S_1$

When the whole is 100 parts by weight (hereinafter, simply referred to as "part"), 93.2 parts of ion-exchanged water, 0.2 part of potassium hydroxide, 0.5 part of quinaldinic acid (as a component forming a water-insoluble compound), 5.0 parts of colloidal silica having an average primary particle diameter of 12 nm and an average particle diameter of 200 nm, 0.1 part of ammonium dodecylbenzenesulfonate, and 1.0 part of ammonium persulfate are blended, and stirred for 3 hours to obtain a slurry $S_1$. The pH of the resulting slurry $S_1$ was 7.2.

(2) Slurry $S_2$

When the whole is 100 parts, 95.5 parts of ion-exchanged water, 0.15 part of ammonia, 0.5 part of quinaldinic acid (as a component forming a water-insoluble compound), 3.5 parts of colloidal silica having an average primary particle diameter of 30 nm and an average particle diameter of 200 nm, 0.1 part of ammonium dodecylbenzenesulfonate and 0.3 part of hydrogen peroxide were blended, and stirred for 3 hours to obtain a slurry $S_2$. The pH of the resulting slurry $S_2$ was 7.6.

[2] Preparation of Composition for Washing Polishing Pad

Compositions A to H for washing polishing pad (A to G; present invention, H; comparative)

When the whole of each composition for washing a polishing pad was 100 parts, a component for rendering water-soluble and a component forming a water-soluble complex shown in Table 1 were blended at a proportion shown in Table 1 (the remaining was ion-exchanged water), and stirred for 30 minutes to obtain compositions A to F for washing a polishing pad.

In addition, when the whole of a composition for washing a polishing pad was 100 parts, only a component for rendering water-soluble or only a component forming a water-soluble complex shown in Table 1 was incorporated at a proportion shown in Table 1 (the remaining was ion-exchanged water), and stirred for 30 minutes to obtain compositions G and H for washing a polishing pad. It is noted that "Ammonia" in Table 1 means a neat ammonia.

TABLE 1

| Composition for washing a polishing pad | Component for rendering water-soluble Component | Content (part) | Component forming a water-soluble complex Component | Content (part) | pH |
|---|---|---|---|---|---|
| A | Ammonia | 5 | Glycine | 5 | 11.0 |
| B | | | Alanine | | 11.1 |
| C | | | Lactic acid | 10 | 10.1 |
| D | | | Citric acid | | 9.9 |
| E | | | Succinic acid | | 10.2 |
| F | TMAH | 5 | Glycine | 5 | 9.9 |
| G | Ammonia | 5 | — | | >14 |
| H | — | | Glycine | 5 | 6.3 |

[3] Regarding Removal Rate in Continuous Polishing (Reference Example)

A blanket Cu wafer having a membrane thickness of 6,000 Å or more as a material to be polished (metal constituting a surface to be polished is copper), 25 wafers were polished continuously by using the slurry $S_1$ obtained in [1] above (that is, without interval dressing between abrasions). The CMP apparatus (manufactured by Ebara Corporation model "EPO-112") was used by applying a porous polyurethane polishing pad (manufactured by Rodalenitta, trade name "IC1000") to a platen of the apparatus in polishing. Supplying rate of the slurry $S_1$ was 200 cc/min., a load of a wafer carrier was 105 hPa, a table rotating number was 100 rpm, and a head rotating number was 101 rpm. Further, each wafer was polished for 1 minute, respectively.

During polishing, a removal rate in each polishing was calculated, and the results are shown in FIG. 1. The removal rates were calculated according to the following equation (1). In addition, a thickness of a copper membrane in the equation (1) was calculated using the following equation (2) from a resistance value measured by a resistivity measuring apparatus (manufactured by NPS Company, model "Σ-10") and a resistivity of a copper membrane (value in literature).

Removal rate (Å/min.)=(thickness of a copper membrane before polishing−thickness of a copper membrane after polishing)/polishing time (1)

Thickness of a copper membrane (Å)=[resistance value ($\Omega/cm^2$)× resistivity of a copper membrane ($\Omega/cm$)]$\times 10^8$ (2)

[4] Regarding the Effects of Composition for Washing Polishing Pad (1) Polishing of Wafer By using the slurry $S_1$ or the slurry $S_2$, a blanket Cu wafer having a membrane thickness of 6,000 Å or more as a material to be polished (metal constituting a surface to be polished is copper), 23 wafers were continuously polished under the same conditions as those in [3]. In this polishing, a removal rate ($V_F$) of a first wafer and a removal rate of 23rd wafer were calculated, and they are shown in Table 2.

TABLE 2

| | | Slurry | Composition for washing a polishing pad | Removal rate $V_F$ of 1st wafer (Å/min) | Removal rate of 23th wafer (Å/min) | Removal rate $V_L$ of 1st wafer after washing (Å/min) | recovery (%) $V_L/V_F \times 100$ |
|---|---|---|---|---|---|---|---|
| Example | 1 | $S_1$ | A | 6,650 | 5,690 | 6,520 | 98.0 |
| | 2 | $S_2$ | | 6,480 | 5,480 | 6,700 | 103.4 |
| | 3 | $S_1$ | B | 6,380 | 5,620 | 6,410 | 100.5 |
| | 4 | $S_2$ | | 6,600 | 5,520 | 6,220 | 94.2 |
| | 5 | $S_1$ | C | 6,460 | 5,630 | 6,100 | 94.4 |
| | 6 | $S_2$ | | 6,570 | 5,590 | 6,220 | 94.7 |
| | 7 | $S_1$ | D | 6,480 | 5,720 | 6,280 | 96.9 |
| | 8 | $S_2$ | | 6,520 | 5,780 | 6,250 | 95.9 |
| | 9 | $S_1$ | E | 6,500 | 5,850 | 6,220 | 95.7 |
| | 10 | $S_2$ | | 6,690 | 5,780 | 6,340 | 94.8 |
| | 11 | $S_1$ | F | 6,410 | 5,300 | 6,100 | 95.2 |
| | 12 | $S_2$ | | 6,290 | 5,450 | 6,090 | 96.8 |
| | 13 | $S_1$ | G | 6,620 | 5,610 | 6,040 | 91.2 |
| Comparative example 1 | | $S_1$ | H | 6,430 | 5,470 | 5,580 | 86.8 |

(2) Washing a Polishing Pad and Dressing (Example)

Then, before polishing 24th wafer, a bare silicon wafer was attached to a wafer carrier, each of compositions A to G for washing a polishing pad obtained in [2] above was supplied at a rate of 200 cc/min., respectively, and washing of a polishing pad was performed for 2 minutes in which a table rotating number was 70 rpm, a load of a wafer carrier was 300 hPa, and a head rotating number was 70 rpm. In a region where a wafer carrier is not present on a polishing pad, interval dressing was performed in which a #100 diamond dresser ring having an external diameter of 270 mm was slid on a polishing pad at a dresser rotating number of 25 rpm and a dresser load of 100 hPa. Immediately thereafter, ion-exchanged water was supplied at a rate of 600 cc/min. for 1 minute to perform water washing.

(3) Washing a Polishing Pad and Dressing (Comparative Example)

According to the same manner as that of the above-mentioned (2) except that $S_1$ was used as a slurry, H as a composition for washing a polishing pad was used and dressing was not performed, washing and water washing of a polishing pad were performed.

(4) Effects by Washing a Polishing Pad

By using the polishing pad after completion of the above-mentioned washing of a polishing pad, polishing of 24th wafer was performed for 1 minute as in (1) above. A removal rate of the 24th wafer was calculated, and the result is also shown in Table 2. In addition, $(V_L/V_F)\times100$ was calculated as a recovery rate from a removal rate ($V_F$) of a first wafer and a removal rate ($V_L$) Of 24th wafer, and the result is also shown in Table 2.

[5] Results

From the results of FIG. 1 in [3], it can be seen that, an initial removal rate (6,500 Å/min.) is almost maintained at a polishing number of around 10, but a removal rate begins to gradually decrease by around 15, and a removal rate is rapidly decreased when the number exceeds 20 (at 25, the rate is decreased from the initial removal rate by about 1,000 Å/min.) in polishing a wafer which forms a water-insoluble compound.

To the contrary, from the results of Table 2 in [4], even in a polishing pad by which 20 or more wafers were continuously polished and in which a removal rate was rapidly decreased in the results of [3], it can be seen that, by performing washing using the composition for washing a polishing pad of the present invention, a removal rate can be recovered to the initial removal rate nearly completely (recovery rate 94.2% or more) as shown in Examples 1 to 13. In particular, it can be seen that, when ammonia is used as a component for rendering water-soluble and glycine is used as a component forming a water-soluble complex, a recovery rate is 98% or more, and excellent effects can be obtained as shown in Examples 1 and 2. To the contrary, it can be seen that a recovery rate in Comparative Example 1 is 86.8%, being inferior as compared with Examples 1 to 13.

What is claimed is:

1. A polishing pad washing composition, which comprises at least one component (A) selected from the group consisting of ammonia, potassium hydroxide, trimethyl-2-hydroxyethylammonium hydroxide, methyltrihydroxyethylammonium hydroxide, and dimethyldihydroxyethylammonium hydroxide for rendering water-soluble a water-insoluble compound containing a metal atom or an ion thereof and at least one component (B) selected from the group consisting of glycine, alanine, cysteine, amidosulfuric acid, lactic acid, citric acid, tartaric acid, malic acid, malonic acid, oxalic acid, succinic acid, fumaric acid and maleic acid for forming a water-soluble complex with said compound containing a metal atom.

2. The composition for washing a polishing pad according to claim 1, wherein said metal is at least one selected from the group consisting of copper, aluminum, tungsten and tantalum.

3. A method for washing a polishing pad to which a water-insoluble compound containing a metal atom or an ion thereof separated from a polished is attached, comprising contacting the polishing pad with a composition comprising at least one component (A) selected from the group consisting of ammonia, potassium hydroxide, trimethyl-2-hydroxyethylammonium hydroxide, methyltrihydroxyethylammonium hydroxide, and dimethyldihydroxyethylammonium hydroxide, for rendering water-soluble a water-insoluble compound containing the metal atom or an ion thereof and at least one component (B) selected from the group consisting of glycine, alanine, cysteine, amidosulfuric acid, lactic acid, citric acid, tartaric acid, malic acid, malonic acid, oxalic acid, succinic acid, fumaric acid and maleic acid, for forming a water-soluble complex with said compound containing a metal atom.

4. The method for washing a polishing pad according to claim 3, wherein said metal is at least one selected from the group consisting of copper, aluminum, tungsten and tantalum.

5. The composition according to claim 1, where the composition is an aqueous solution.

6. The composition as claimed in claim 5, having a pH of 9 or greater.

7. The composition according to claim 1, wherein the component (A) is ammonia and the component (B) is glycine.

8. The composition as claimed in claim 5, wherein the component (A) is present in an amount of from 0.5 to 10% by weight based on a 100% by weight of the entire composition.

9. The composition as claimed in claim 5, wherein the component (B) is present in an amount of from 0.5 to 15% by weight based on 100% by weight of the entire composition.

10. The composition as claimed in claim 1, consisting essentially of water, the component (A) and the component (B).

11. The composition according to claim 1, comprising ammonia, water and at least one selected from the group consisting of glycine, alanine, lactic acid, citric acid, and succinic acid, and having a pH of from 9.9 to 11.1.

12. The method as claimed in claim 3, wherein the composition is an aqueous composition.

13. The method according to claim 3, wherein the polishing pad is contacted with the composition at a pH of 9 or greater.

14. The method according to claim 3, wherein the component (A) comprises ammonia.

15. The method according to claim 3, wherein the composition comprises from 0.5 to 10% by weight of the component (A).

16. The method according to claim 3, wherein the composition comprises the component (B) in an amount of from 0.5 to 15% by weight based on a 100% by weight of the entire composition.

17. The method according to claim 3, wherein the composition consists essentially of water, the component (A) and the component (B).

18. The method according to claim 3, wherein the composition comprises water, ammonia and at least one selected from the group consisting of glycine, alanine, lactic acid, citric acid and succinic acid, and has a pH of from 9.9 to 11.1.

* * * * *